US011815342B2

(12) United States Patent
Tubb

(10) Patent No.: US 11,815,342 B2
(45) Date of Patent: Nov. 14, 2023

(54) METHOD FOR MAKING PRECISION RIFLE AMMUNITION WITH MORE UNIFORM EXTERNAL BALLISTIC PERFORMANCE AND ENHANCED TERMINAL BALLISTIC PERFORMANCE

(71) Applicant: SUPERIOR SHOOTINGS SYSTEMS, INC, Canadian, TX (US)

(72) Inventor: G. David Tubb, Canadian, TX (US)

(73) Assignee: Superior Shooting Systems, Inc., Canadian, TX (US)

( * ) Notice: Subject to any disclaimer, the term of this patent is extended or adjusted under 35 U.S.C. 154(b) by 0 days.

(21) Appl. No.: 17/892,892

(22) Filed: Aug. 22, 2022

(65) Prior Publication Data

US 2023/0056228 A1 Feb. 23, 2023

Related U.S. Application Data

(60) Division of application No. 16/726,674, filed on Dec. 24, 2019, now Pat. No. 11,421,967, which is a (Continued)

(51) Int. Cl.
*F42B 5/02* (2006.01)
*F42B 10/44* (2006.01)

(Continued)

(52) U.S. Cl.
CPC ..... *F42B 5/025* (2013.01); *F42B 10/44* (2013.01); *F42B 10/46* (2013.01); *F42B 12/74* (2013.01); *F42B 12/76* (2013.01)

(58) Field of Classification Search
CPC ..... F42B 5/025; F42B 10/44; F42B 10/46; F42B 12/74; F42B 12/76

(Continued)

(56) References Cited

U.S. PATENT DOCUMENTS 2,871,787 A * 2/1959 Rizer ..... F23Q 2/287 102/210
4,004,519 A * 1/1977 Hopkins ..... F42C 11/04 102/208

(Continued)

FOREIGN PATENT DOCUMENTS

EP 3187817 A2 7/2017
WO WO 2014/094000 6/2014
WO WO 2019/010040 1/2019

OTHER PUBLICATIONS

PCT International Search Report, PCT/US2018/039602, dated Feb. 6, 2019, pp. 1-2.

(Continued)

*Primary Examiner* — Samir Abdosh
(74) *Attorney, Agent, or Firm* — J. Andrew McKinney, Jr.; McKinney & Associates, LLC

(57) ABSTRACT

A method for making an improved projectile 360, 460 by defining a discontinuity, groove or trough in a distal ogive section of the projectile to provide an external ballistic. effect uniforming surface feature (e.g., nose ring groove 369, 469) which makes an unsupported gap in the ogive profile that beneficially affects the flow of air over the front half of the ogive. The improved bullet's external surface discontinuity feature (369 or 469) creates effects in the flowfield that dominate any dynamic effects from bullet-to bullet manufacturing inconsistency and resultant differences in dynamic behavior.

6 Claims, 19 Drawing Sheets

Related U.S. Application Data continuation of application No. PCT/US2018/039602, filed on Jun. 26, 2018.

(60) Provisional application No. 62/525,185, filed on Jun. 26, 2017.

(51) Int. Cl.
*F42B 10/46* (2006.01)
*F42B 12/74* (2006.01)
*F42B 12/76* (2006.01)

(58) Field of Classification Search
USPC ..... 102/439
See application file for complete search history.

(56) References Cited

U.S. PATENT DOCUMENTS 4,517,897 A * 5/1985 Kneubuhl ..... F42B 30/02 102/501
4,547,949 A * 10/1985 Heller ..... F42B 30/08 29/421.2
4,685,397 A 8/1987 Schirneker
5,400,716 A * 3/1995 Mayer ..... F42B 12/78 102/517
6,070,532 A 6/2000 Halverson
6,374,743 B1 4/2002 Hug et al.
9,534,876 B2 1/2017 Silvers
11,421,967 B2 8/2022 Tubb et al.
2007/0204758 A1 9/2007 Spatz et al.
2013/0167747 A1 7/2013 Luchini et al.
2014/0318405 A1 10/2014 Dikhoff et al.
2015/0192394 A1 7/2015 Fritz
2015/0226531 A1 8/2015 Brands
2015/0354932 A1* 12/2015 Schnabel ..... F42B 10/24 102/501
2016/0153757 A1 6/2016 Mahnke
2016/0327380 A1* 11/2016 Kunz ..... F42B 10/44
2019/0316888 A1* 10/2019 Thielen ..... F42B 12/34
2020/0033102 A1* 1/2020 Burrow ..... F42B 12/58
2020/0240758 A1* 7/2020 Thompson ..... F42B 10/24
2020/0284560 A1 9/2020 Tubb
2020/0393224 A1* 12/2020 Wagner ..... F42B 10/46
2021/0172717 A1* 6/2021 Schorr ..... F42B 10/46

OTHER PUBLICATIONS

List of Applicant Application(s) Treated as Related.
Extended European Search Report and Examination Report for EP18827846.9 dated Feb. 24, 2021, pp. 1-8.

* cited by examiner

Bullet Name: 6mm 115gr DTAC - 0.10, 45°,0.130

| | w/o Ring | w/ Ring |
|---|---|---|
| BC Min | 0.620 | 0.581 |
| BC Max | 0.655 | 0.585 |
| SD | 0.024 | 0.002 |
| ES | 0.036 | 0.003 |

| Round Number | Muzzle Unit VelAC | Prf Vel | Square Target 995.7 Y T.O.F. | Square B.C. | Vel-T | Horz. | Vert. |
|---|---|---|---|---|---|---|---|
| 1 | 3244 | -2.6 | 1.16093 | 0.655 | 2047 | -14.7 | 27.9 |
| 2 | 3234 | -5.2 | 1.16515 | 0.655 | 2039 | -11.3 | 32.7 |
| 3 | 3230 | -1.3 | 1.16862 | 0.651 | 2030 | 6.7 | 22.7 |
| 4 | 3239 | -2.6 | 1.18037 | 0.620 | 1984 | -3.3 | 18.1 |
| 5 | 3245 | -1.3 | 1.16402 | 0.648 | 2036 | 4.7 | 24.1 |

| | Muzzle Unit VelAC | Prf Vel | Square Target 995.7 Y T.O.F. | Square B.C. | Vel-T | Horz. | Vert. |
|---|---|---|---|---|---|---|---|
| Avg | 3236 | -2.6 | 1.16782 | 0.646 | 2027 | -3.6 | 25.1 |
| SD | 6 | 1.6 | 0.00670 | 0.014 | 23 | 7.6 | 5.3 |
| High | 3245 | -1.3 | 1.18037 | 0.655 | 2047 | 6.7 | 32.7 |
| Low | 3230 | -5.2 | 1.16093 | 0.620 | 1984 | -14.7 | 18.1 |
| ES | 15 | 3.9 | 0.01944 | 0.036 | 63 | 21.4 | 14.6 |
| Group Size | | | | | | 20.6 | |
| Radial SD | | | | | | 9.3 | |

| | |
|---|---|
| Test File Name: | DTAC 115 Standard (No Ring) |
| Temperature: | 80°F |
| Barometric Pressure: | 26.86 in Hg |
| Humidity: | 30% |
| Wind Speed: | 6 mph |
| Wind Direction: | 09.00 o'clock |
| Drag Function: | G1 |

FIG. 4A

| Round Number | Muzzle Unit VelAC | Prf Vel | Subsonic Target 1993.7 Y T.O.F. | B.C. |
|---|---|---|---|---|
| 9 | 3185 | -2.5 | - | - |
| 10 | 3178 | -1.3 | - | - |
| 11 | 3195 | 0.0 | 3.36244 | 0.585 |
| 12 | 3194 | -1.3 | 3.37540 | 0.581 |
| 13 | 3182 | -2.5 | - | - |
| 14 | 3178 | -1.3 | - | - |
| 15 | 3194 | -1.3 | - | - |
| 16 | 3192 | 0.0 | - | - |
| 17 | 3187 | -2.5 | 3.38137 | 0.582 |
| 18 | 3197 | -2.6 | | |

| | Muzzle Unit VelAC | Prf Vel | Subsonic Target 1993.7 Y T.O.F. | B.C. |
|---|---|---|---|---|
| Avg | 3186 | -1.4 | 3.37307 | 0.583 |
| SD | 9 | 1.0 | 0.00968 | 0.002 |
| High | 3197 | 0.0 | 3.38137 | 0.585 |
| Low | 3170 | -2.6 | 3.36244 | 0.581 |
| ES | 27 | 2.6 | 0.01893 | 0.003 |
| Group Size | | | | |
| Radial SD | | | | |

Test File Name: 65456-010-45 degree 130 from tip
Location: TUBB Range
Operator: DT
Test Date: 05/18/2017 11:05
Temperature: 77°F
Barometric Pressure: 26.92 in Hg
Altitude: 0 feet
Humidity: 37%
Wind Speed: 14 mph
Wind Direction. 06.00 o'clock
Drag Function: G1

Unit 1 Muzzle Velocity:
Serial Num.: 40C91F48
Signal Level: 80
ScrA to ScRC: 8.0

Unit 2
Serial No.: 40CE00D9
Type: Subsonic Target
Size: 5.0
Signal Level: 80
Range: 2000.0

Test Note:
65456.010 - 45 degrees 130 from tip
2004 Yard Subsonic test - wind blowing 14-16 mph - hard to hit the target for data
bullet hit nose on which indicates stability

FIG. 4B

| | w/o Ring | w/ Ring |
|---|---|---|
| BC Min | 0.928 | 0.932 |
| BC Max | 0.977 | 0.940 |
| SD | 0.019 | 0.003 |
| ES | 0.049 | 0.008 |

| Round Number | Muzzle Unit VelAC | Prf Vel | Square Target 995.7 Y T.O.F. | Square B.C. | Vel-T | Horz. | Vert. |
|---|---|---|---|---|---|---|---|
| 1 | 2844 | 0.0 | 1.21629 | 0.972 | 2094 | -13.0 | 5.3 |
| 2 | 2879 | -1.0 | 1.22887 | 0.928 | 2055 | -6.7 | 8.0 |
| 3 | 2875 | -1.0 | 1.22150 | 0.968 | 2083 | -4.7 | 11.1 |
| 4 | 2874 | 0.0 | 1.21989 | 0.977 | 2089 | -4.1 | 13.1 |
| 5 | 2866 | 1.0 | 1.22546 | 0.967 | 2075 | -0.5 | 10.9 |

| | Muzzle Unit VelAC | Prf Vel | Square Target 995.7 Y T.O.F. | Square B.C. | Vel-T | Horz. | Vert. |
|---|---|---|---|---|---|---|---|
| Avg | 2875 | -0.2 | 1.22240 | 0.962 | 2079 | | |
| SD | 5 | 0.9 | 0.00382 | 0.019 | 13 | | |
| High | 2884 | 1.0 | 1.22887 | 0.977 | 2094 | | |
| Low | 2866 | -1.0 | 1.21629 | 0.928 | 2055 | | |
| ES | 18 | 2.1 | 0.01259 | 0.050 | 39 | 12.5 | 7.8 |
| Group Size | | | | | | 6.8 | |
| Radial SD | | | | | | 3.6 | |

| | |
|---|---|
| Test File Name: | 375 CAL TURNED SOLID Standard (No ring) |
| Temperature: | 73°F |
| Barometric Pressure: | 27.05 in Hg |
| Altitude: | 0 feet |
| Humidity: | 71% |
| Wind Speed: | 2 mph |
| Wind Direction: | 05.00 o'clock |
| Drag Function: | G1 |

FIG. 7A

| Round Number | Muzzle Unit VelAC | Prf Vel | Square Target 995.7 Y T.O.F. | Square B.C. | Vel-T | Horz. | Vert. |
|---|---|---|---|---|---|---|---|
| 1 | 2874 | 0.0 | 1.22954 | 0.935 | 2057 | -5.6 | 10.3 |
| 2 | 2870 | 1.0 | 1.22984 | 0.940 | 2058 | -5.7 | 9.6 |
| 3 | 2875 | 1.0 | 1.22896 | 0.935 | 2058 | -1.0 | 8.5 |
| 4 | 2877 | 1.0 | 1.22771 | 0.936 | 2061 | -4.4 | 10.2 |
| 5 | 2882 | 0.0 | 1.22635 | 0.932 | 2061 | -5.3 | 8.8 |

| | Muzzle Unit VelAC | Prf Vel | Square Target 995.7 Y T.O.F. | Square B.C. | Vel-T | Horz. | Vert. |
|---|---|---|---|---|---|---|---|
| Avg | 2875 | 0.6 | 1.22848 | 0.936 | 2059 | | |
| SD | 4 | 0.5 | 0.00134 | 0.003 | 2 | | |
| High | 2882 | 1.0 | 1.22984 | 0.940 | 2061 | | |
| Low | 2870 | 0.0 | 1.22635 | 0.932 | 2057 | | |
| ES | 12 | 1.0 | 0.00349 | 0.007 | 4 | 4.7 | 1.9 |
| Group Size | | | | | | 4.9 | |
| Radial SD | | | | | | 2.0 | |

| | |
|---|---|
| Test File Name: | 375 CAL TURNED NOSE RING 220X010 |
| Temperature: | 73°F |
| Barometric Pressure: | 27.05 in Hg |
| Altitude: | 0 feet |
| Humidity: | 71% |
| Wind Speed: | 2 mph |
| Wind Direction: | 05.00 o'clock |
| Drag Function: | G1 |

FIG. 7B

METHOD FOR MAKING PRECISION RIFLE AMMUNITION WITH MORE UNIFORM EXTERNAL BALLISTIC PERFORMANCE AND ENHANCED TERMINAL BALLISTIC PERFORMANCE

PRIORITY CLAIMS AND CROSS-REFERENCE TO RELATED APPLICATIONS

This application is a divisional of and claims the priority benefit of (a) U.S. nonprovisional patent application Ser. No. 16/726,674, entitled "Enhanced Nose Ring Projectile, Cartridge and Method for creating long-range/precision rifle ammunition with more uniform shot-to-shot external ballistic performance" which was filed on Dec. 24, 2019. now U.S. Pat. Ser. No. 11,421,967, which is a continuation of(b) U.S. PCT patent application no. PCT/US18/39602, entitled "Enhanced Nose Ring Projectile, Cartridge and Method for creating long-range/precision rifle ammunition with more uniform shot-to-shot external ballistic performance" which was filed on Jun. 26, 2018, which claims the benefit of priority of (c) U.S. provisional patent application No. 62/525,185, entitled "Enhanced Nose Ring Projectile, Cartridge and Method for creating long-range/precision rifle ammunition with more uniform shot-to-shot external ballistic performance" which was filed on Jun. 26, 2017, the entire disclosures of which are incorporated herein by reference.

BACKGROUND OF THE INVENTION

Field of the Invention

The present invention relates to methods for making ammunition used in firearms and more particularly to Projectiles, commonly referred to as Bullets, for use with small arms and particularly ammunition intended for use in rifles configured for Long Range shooting applications.

Discussion of the Prior Art

Modern firearms such as rifles (e.g., 10, as shown in FIG. 1A) make use of cartridges that include a projectile seated in a cartridge casing (e.g., 50, as illustrated in FIGS. 1B and 1C). The cartridge casing (e.g., 150 as shown in FIGS. 1B and 1C) has an internal cavity 156 defined therein that contains a charge of rapidly combusting propellant or powder. A primer 70 is seated in a recess formed in a rear or proximal portion of the casing with a primer flash hole that places the primer 70 in communication with the internal cavity 156 containing the powder. A bullet or projectile 60 is seated in the front or distal portion of the casing 150 such that the powder is sealed and contained in the casing between the primer and the projectile.

The rifle's action 4 is used to advance the cartridge 50 into a firing chamber aligned with rifle barrel 6 in preparation for firing. The rifle's action is configured to respond to a trigger mechanism used to release a sear and cause a firing pin or striker to impact the primer 70, then causing the primer to ignite. The primer's ignition is directed into the powder which burns within the casing 150 and generates a rapidly expanding volume of gas which propels and accelerates the projectile or bullet 60 distally out of the casing, down the length of the barrel's bore and downrange.

In order to establish some nomenclature for bullet construction and external ballistics, it is useful to review some examples. The rifle cartridge 50 illustrated in FIGS. 1B and 1C is a 1970s era military cartridge known as the 7.62 mm (or 7.62×51) NATO M118 "special bail" or "match" cartridge and this cartridge was widely used for rifle marksmanship competitions and other applications (e.g., military sniping) requiring precise rifle fire. The M118 special bail Full Metal Jacket Boat Tail ("FMJBT") projectile 60 (designated the M72 ball bullet) consisted of a copper alloy gilding metal jacket enveloping a lead-antimony alloy slug or core weighing to provide a solid projectile weighing 173 grains. In the 1980s, the US military sought more accurate rifle ammunition and the M852 cartridge using the Sierra® MatchKing® ("SMK") 168gr bullet was found to provide an improvement over the M118 cartridge, but the M852 cartridge was not ideal for longer ranges (e.g., beyond 800 yards). Sierra designed the 168gr SMK for 300 meter (e.g., Olympic or International) rifle competition and as such they did not focus on longer range ballistic stability (i.e., where the decelerating bullet's velocity fall into or below the transonic range). The 168gr SMK design incorporated a sharp (i.e., 13 degree) boat tail instead of the 9 degree taper that is found on the 173gr M72 bullet 60. It was determined that when the 168gr SMK bullet dropped in velocity into the "transonic" range (below about Mach 1.2 or about 1340 fps at sea level) at about 700 yards, the air flowing around the bullet (or "Flowfield") no longer followed the 13 degree boat tail and separated erratically (creating "flow shocks" and unstable regions of turbulence around the boat tail, causing yaw instability, inaccuracy (meaning erratically inconsistent response) and inefficiency at longer ranges. Because of this, the M852's performance suffered at long ranges (beyond 800 yds).

In ballistics science, "external ballistics" refers to the effects of the ambient atmosphere on bullets, in flight. FIGS. 1D and 1E are shadowgraph images which illustrate the effects created in air as a bullet pushes through the air at varying velocities. Naturally, the forces from the air affect the bullet's flight and instabilities create poor shot-to-shot repeatability, reliability and accuracy. These forces and their effects on a bullet's external ballistic performance are described in Robert L. McCoy's text "Modern Exterior Ballistics", especially Chapter 4 (Notes on Aerodynamic Drag), and section 4.4 (Airflow Regimes). Referring initially to FIG. 1D, when a bullet (e.g., 60) exits the muzzle of a precision rifle (e.g., 10), it generally travels at a rate of two or more times the speed of sound (the speed of sound is approximately 343 m/s, or 1125 fps, in standard atmospheric conditions), so at the muzzle, bullet speed is considered supersonic (M>>1). When the bullet flies supersonic, it compresses the air in front of itself, generating a series of shockwaves that originate from the bullet's distal tip or point in a flowfield that propagates around behind the bullet as a cone. In FIG. 1D, the shockwaves and flowfield are illustrated in a shadowgraph photo of a supersonic bullet in flight at Mach 2.66 (that is, 2.66 times the speed of sound). When the bullet flies at supersonic velocity, the center of pressure is between the bullet tip and the center of gravity. There is also a turbulent region of vacuum directly behind the bullet's base. As the bullet flies downrange, unless something is impacted, air resistance or "drag" slows the bullet and the bullet's velocity eventually reaches the "transonic region" where its speed reaches Mach 1.2. Going farther, its speed falls below that of the sound barrier at Mach 1, and then it slows beyond the transonic region when its speed falls below Mach 0.8. Changes in the flowfield around the bullet during the transonic transition are illustrated in the sequence of four shadowgraph pictures of FIG. 1E.

During the transonic transition portion of the bullet's flight, ballistic stability and accuracy are affected in surprising ways because the center of pressure shifts forward toward the distal tip of the bullet. The shifting of the center of pressure lengthens the lever between it and the center of gravity, amplifying static and dynamic instability, so any dynamic imperfection in the bullet is amplified. The result is that the bullet's angle of attack and yaw can dramatically change, making it difficult or impossible to compensate correctly for drop and drift. For some conventional bullets, it also produces an increase in cyclic yaw or wobble, which can lead to accuracy decay and can cause the bullet to tumble. These unpredictable instabilities are why, when using conventional bullets, shooting beyond the transonic range (the distance at which the residual speed reaches Mach 1.2) results in erratic accuracy and even "key holes" (e.g., holes made on a target by tumbling bullets that impact on their side instead of at their tip). When using conventional bullets, ballistic stability and accuracy when decelerating through the transonic region are hard to predict because too many factors come in play—many of those factors are not measurable without very specialized equipment. As a result, conventional wisdom is that shooting at distant targets for which bullet's velocity will drop into the transonic region should be avoided.

Returning to our historical narrative, in 1993, new design specifications for an improved 7.62×51 mm NATO long range (sniping) cartridge dubbed the M118 Special Ball Long Range (M118LR) were developed with a projectile now known as the 175gr Sierra Match King ("SMK") bullet 160, which, incorporated a 9 degree boat tail 172 resembling the M118/M72 bullet design (see, e.g., FIG. 1F). The 175gr SMK bullet is shown with a meplat at its open distal tip 162, and the curved portion of the front or distal segment of the bullet is called the "ogive" 168 which typically is curved in a selected radius (2.24" as seen in FIG. 1F). The sleekness and aerodynamic efficiency of a bullet is often described in terms of "Caliber of Ogive", which is a dimensionless number. The higher the "caliber of ogive" number, the sleeker (and less affected by drag) the bullet. This metric makes it easy to compare the ogives of different caliber bullets, so if one wants to know if a certain 308 caliber bullet is sleeker than a 7 mm bullet, one simply compares their "caliber of ogive" numbers. Referring again to FIG. 1F, to find the "caliber of ogive" for 30 caliber 175 gr HPBT bullet it is noted that the actual radius of ogive 168 is 2.240 inches. Taking that 2.240" ogive radius and dividing by the diameter (or caliber) of the bullet, one obtains 7.27 "calibers of ogive" (i.e., 2.240÷0.308=7.27).

Referring to FIG. 1G, another SMK bullet 200 is shown in side elevation beside the same bullet shown cut in half to reveal its cross section. Rifle bullets (e.g., 60, 160 or 200) are often made with dense lead alloy cores 220 enveloped within a copper-zinc alloy (also known as gilding metal) jacket 240 as best seen in the sectioned view of FIG. 1G. The gilding metal jacket 240 envelops or encases the core 220 to provide a uniform and precisely balanced one-piece projectile and the jacket 240 is thin enough in section or profile (e.g., 0.020-0.024 inches) and ductile enough to deform adequately under the engraving stresses encountered within the rifle's bore, transferring stabilizing spin from the bore's rifling while retaining projectile integrity when the projectile leaves the muzzle of the rifle 10.

Marksmen have ever-increasing demands for accuracy and precision so long, VLD (very low drag) bullet profiles were developed such as the Tubb® DTAC® 6 mm 115 gr bullet or the Sierra® MatchKing® 6 mm 110 gr bullet (e.g., 260, as shown in FIG. 1H) for long range competition shooting. VLD bullet 260 has a distal tip 262 which may terminate distally in a point or an open tip with or without a meplat. The distal tip 262 is axially aligned along central axis of rotation 266 with an ogive section 268 which grows in diameter toward the full caliber diameter central bearing section 270. The bearing section 270 is substantially cylindrical and has a constant circumference and diameter along its length 270L to the proximal boat tail section 272. VLD bullet 260 may include a lead alloy core covered in a gilding metal or copper alloy jacket to provide a smooth continuous outer surface. Many conventional match grade, precision and VLD configuration rifle bullets (e.g., 60, 160, 200 or 260) provide a smooth and continuous outer surface extending from the distal tip (e.g., 262) to the proximal base surface (e.g., 264) and that smooth continuous sidewall which extends over the ogive, the bearing surface and the boat-tail sidewall contributes to aerodynamic efficiency, thus providing a higher ballistic coefficient ("BC"). Any of these prior art bullets (e.g., 60, 160, 200 or 260) could be manufactured differently and instead of using a jacketed core to define a unitary integral structure with a smooth external surface, they could be made from a monolithic solid metal (e.g., copper or bronze alloy) bar stock segment to provide a "turned solid" projectile, such as those described in U.S. Pat. No. 4,685,397 (to Schirnecker) or U.S. Pat. No. 6,070,532 (to Halverson), but with a smooth continuous sidewall which extends over the ogive, the bearing surface and the boat-tail sidewall (like the turned solid 375 Lapua™ bullet as is now sold by the Nammo-Lapua company.

VLD bullet 260 and the Tubb® DTAC® 6 mm 115 gr bullet have proven to be more accurate and reliably stable in competition shooting than prior conventional bullets (e.g., 60 or 160), but even greater accuracy, uniformity and shot-to-shot consistency and repeatability are sought by competition and long range shooters who want more uniform observed external ballistics at supersonic, transonic and subsonic velocities. Long range hunters who hunt especially wary predators and varmints want projectiles to deliver greater accuracy, uniformity, shot-to-shot consistency and superior terminal ballistics, as well. As noted above, any bullet is manufactured to certain tolerances, and any bullet-to-bullet manufacturing inconsistency will give rise to a difference in dynamic behavior and be observable in changing flowfield effects and more variable external ballistics, especially as the bullet, decelerates through the transonic region.

There is a need, therefore, for a novel ammunition configuration and a new projectile and method which provide the benefits of greater accuracy, uniformity and shot-to-shot consistency and repeatability, more uniform observed external ballistics and superior terminal ballistics.

SUMMARY OF THE INVENTION

The method of the present invention includes fabricating or modifying a bullet or projectile to include an external surface discontinuity feature 369 which creates improved and more uniform effects in the bullet's flowfield when in flight. The method provides an accurate, consistent and reliably deadly ammunition configuration which provides material and surprising ballistic performance improvements over the prior art bullets of FIGS. 1B-1H The projectile and method of the present invention provide a mechanism to reduce the effects of any bullet-to-bullet inconsistency including resulting differences in dynamic behavior which are amplified when the bullet flies through the air and the changing flow field affects external ballistics, especially in the transonic region.

The novel projectile configuration and method of the present invention provide the sought after benefits of greater uniformity and shot-to-shot consistency and repeatability, with more uniform observed external ballistics (especially at longer ranges, and when transitioning from supersonic flight to subsonic flight) and also provide superior terminal ballistics.

In a preferred exemplary embodiment of the present invention, a new VLD projectile or rifle bullet is fabricated with or modified to include an external surface discontinuity feature in the distal ogive section to provide an unsupported gap in the ogive profile which affects the flow of air over the front half of the ogive to provide greater aerodynamic uniformity and shot-to-shot consistency with more uniform observed external ballistics and superior terminal ballistics. The bullet's external surface discontinuity feature creates effects in the flowfield that dominate any dynamic effects from bullet-to-bullet manufacturing inconsistency and resultant differences in dynamic behavior. In the preferred embodiment, an engraved or molded-in circumferential groove or ring having a selected profile and depth (e.g., 0.004"-0.015") near the bullet's distal tip (e.g., within 3-25% of the bullet's OAL, and preferably within 100 to 200 thousandths of an inch from the distal tip or meplat of the bullet). The circumferential groove or nose ring is preferably engraved as a complete circle defined within a transverse plane bisecting the bullet's central axis in the forward ogive section and so is well forward of the central cylindrical bearing surface section of the bullet and well forward of the center of mass. The ring is defined solely in the distal portion of the nose or ogive portion of the projectile's outer surface, in accordance with the preferred embodiment of the present invention.

The ringed bullet of the present invention provides surprisingly uniform shot-to shot external ballistic performance, meaning the demonstrated, measured ballistic coefficient for a selected plurality of identically made ringed VLD bullets will be much more uniform than the measured ballistic coefficient for a plurality of standard (no-ring) VLD bullets. The ringed bullet of the present invention is in many respects similar to the Tubb® DTAC® 6 mm 115 gr bullet or the Sierra® MatchKing® 6 mm 110 gr bullet (e.g., 260, as shown in FIG. 1H) already well known for long range competition shooting, as described above. The ringed VLD bullet of the present invention has a distal tip which may terminate distally in a point or an open tip with or without a meplat. The distal tip may be closed and pointed. The distal'tip is axially aligned along the bullet's central axis of rotation with an ogive section which grows in diameter toward the full caliber diameter of the central bearing section. The bearing section is cylindrical and has a constant circumference and diameter along its length to the proximal boat tail section. The ringed VLD bullet of the present invention may be made from solid copper or bronze alloy or may include a lead alloy core covered in a gilding metal or copper alloy jacket to provide a smooth and continuous outer surface extending from the distal tip to the proximal base surface where that smooth continuous surface has only one discontinuity, located within 10% of the bullet's OAL of the distal tip, and that one discontinuity is defined by the circumferential ring-shaped shallow groove or trough.

The method of manufacturing and assembling the ammunition of the present invention includes the method steps of making or providing a solid or jacketed bullet with an overall axial length ("OAL") along a bullet central axis from a distal tip or meplat to a proximal base or tail, where the bullet's sidewall surface includes a radiussed ogive section extending proximally from the distal tip to a cylindrical sidewall bearing section. Next, the method includes engraving, defining or cutting a circumferential trough or groove (or "nose ring") discontinuity feature into the bullet's sidewall surface at a selected axial length or nose length which is preferably ten percent (10%) of the bullet's OAL, where the nose ring discontinuity is defined in transverse plane intersecting the bullet's central axis. To make a cartridge, that enhanced bullet Is aligned coaxially with and inserted into a cartridge case with a substantially cylindrical body which is symmetrical about a central axis extending from a substantially closed proximal head to a substantially open distal mouth or lumen, where the body defines an interior volume for containing and protecting a propellant charge, and wherein the cartridge neck is configured to be substantially cylindrical segment extending from the distal neck end which defines the neck lumen rearwardly or proximally to an angled shoulder segment which flares out to the cylindrical body sidewall, and wherein the cartridge neck has a neck lumen interior sidewall with a selected axial neck length, sized to receive and hold the bullet's cylindrical sidewall.

The above and still further features and advantages of the present invention will become apparent upon consideration of the following detailed description of a specific embodiment thereof, particularly when taken in conjunction with the accompanying drawings, wherein like reference numerals in the various figures are utilized to designate like components.

BRIEF DESCRIPTION OF THE DRAWINGS

FIG. 4A is a diagram with tables illustrating ballistics testing performance data recorded for experiments with a standard VLD (6 mm DTAC™) projectile, without the circumferential nose ring (data also annotated in FIG. 3A).

FIG. 4B is a diagram with tables illustrating ballistics testing performance data recorded for experiments with the enhanced VLD projectile of FIGS. 3A and 3B showing the shot-to-shot external ballistics (BC) uniforming effect caused by inclusion of the external surface discontinuity feature engraved or cut into the distal portion of the ogive of the projectile's outer surface, in accordance with the present invention.

FIG. 7A is a diagram with tables illustrating ballistics testing performance data recorded for experiments with a standard 375 Caliber Turned Solid VLD projectile, without the circumferential nose ring (data also annotated in FIG. 6).

FIG. 7B is a diagram with tables illustrating ballistics testing performance data recorded for experiments with the enhanced VLD projectile of FIGS. 5A, 5B, 5C and 6 showing the shot-to-shot external ballistics (BC) uniforming effect caused by inclusion of the external surface discontinuity feature engraved or cut into the distal portion of the ogive of the projectile's outer surface, in accordance with the present invention.

DETAILED DESCRIPTION OF THE PREFERRED EMBODIMENTS

Figure 1A:
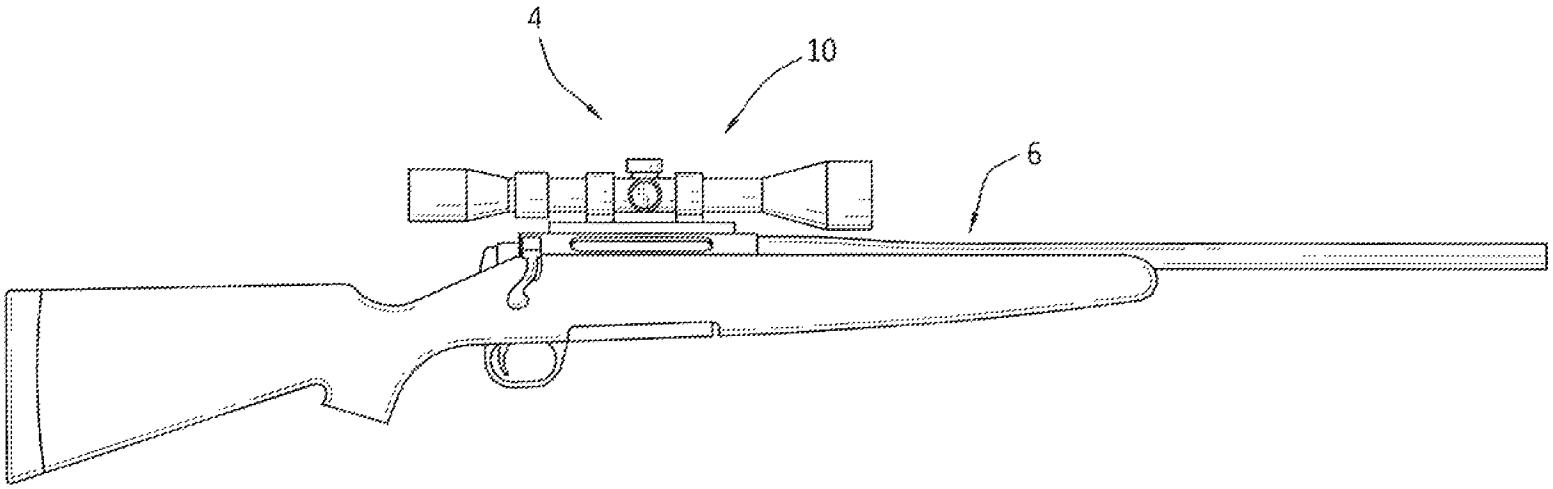
FIG. 1A PRIOR ART
FIG. 1A illustrates a conventional rifle in accordance with the Prior Art, and is useful for understanding the nomenclature and context of the present invention.
Figure 1C:
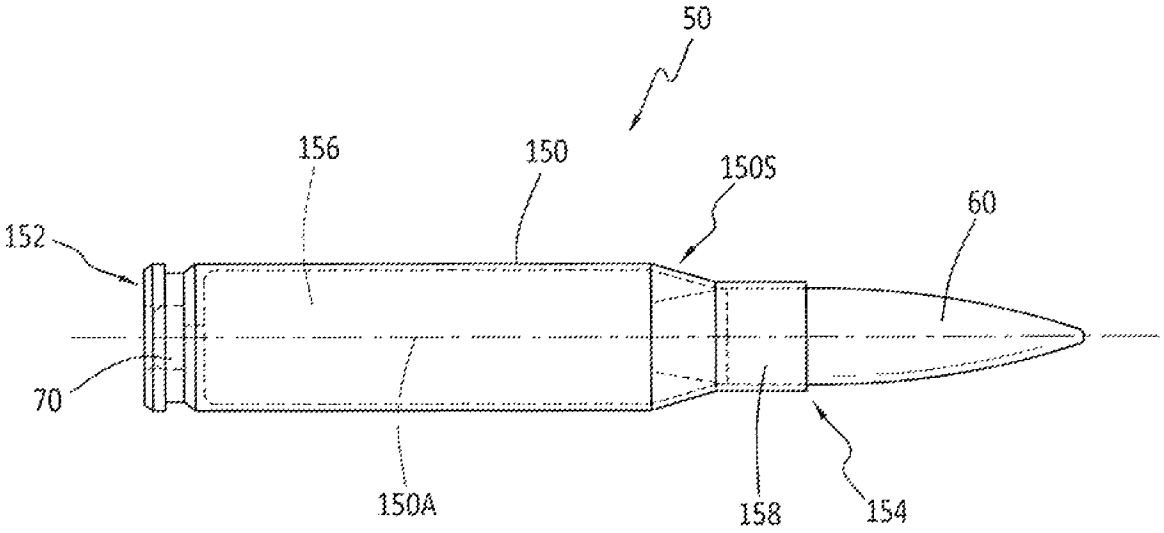
FIGS. 1B-1G illustrate conventional cartridges and bullets for use in the rifle of FIG. 1A, in accordance with the Prior Art, and are also useful for understanding the nomenclature and context of the present invention.
Figure 1B:
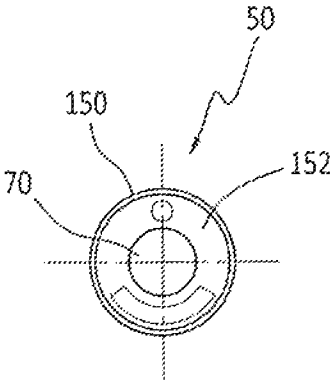
Figure 1D:
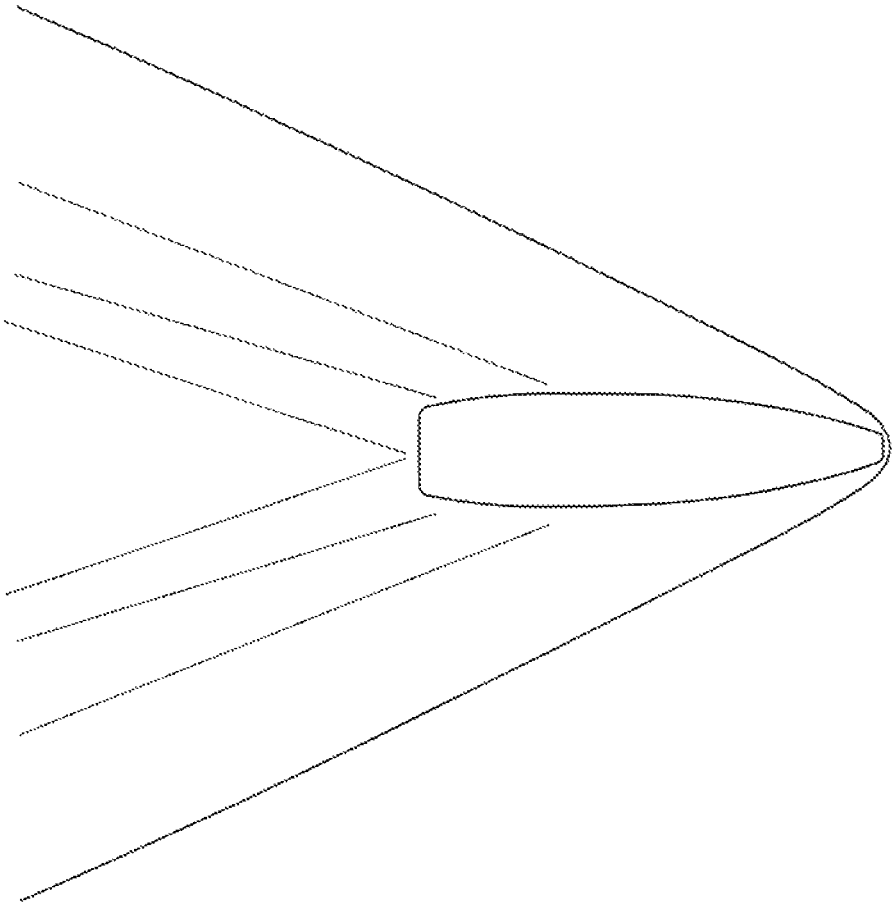
Figure 1E:
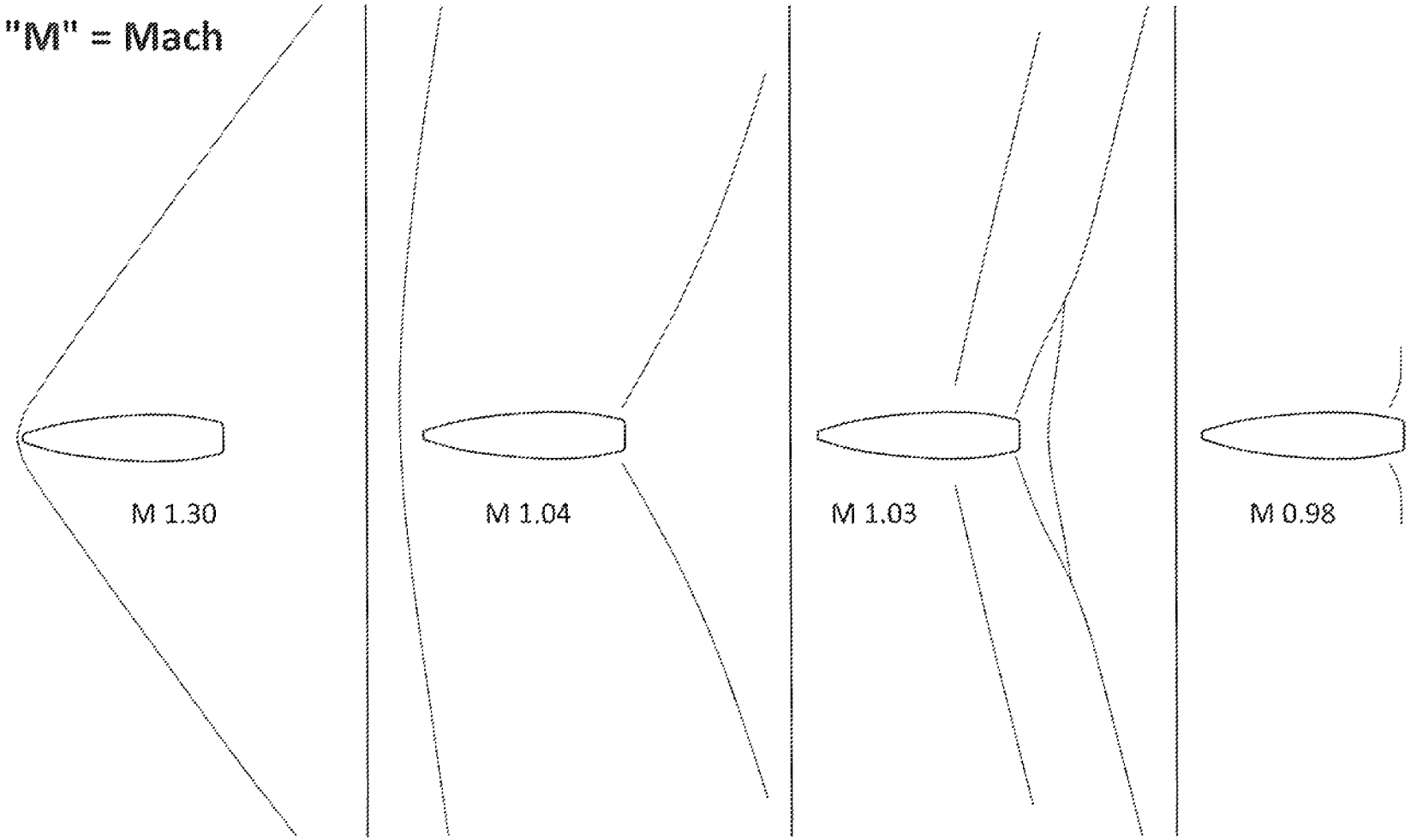
Figure 1F:
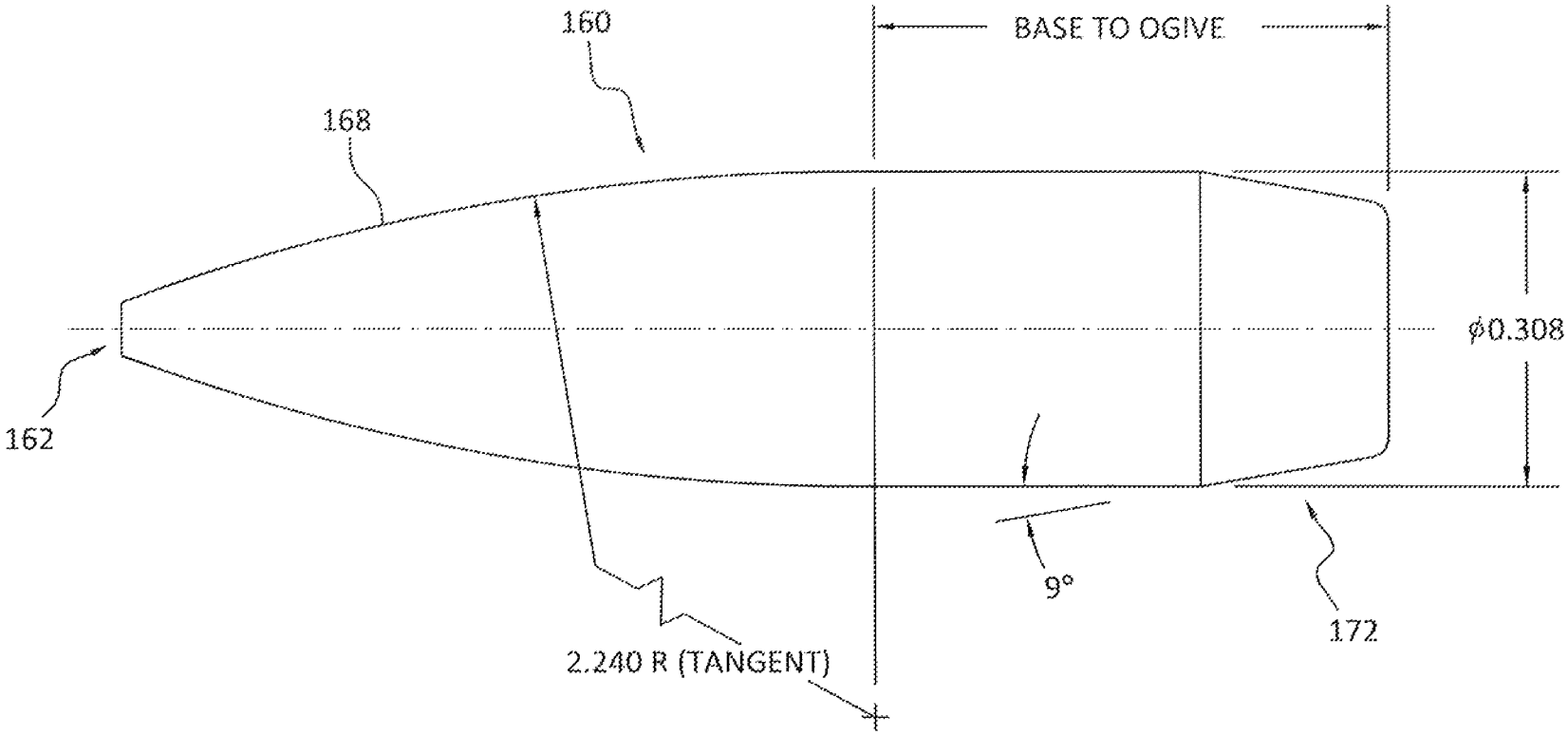
Figure 1G:
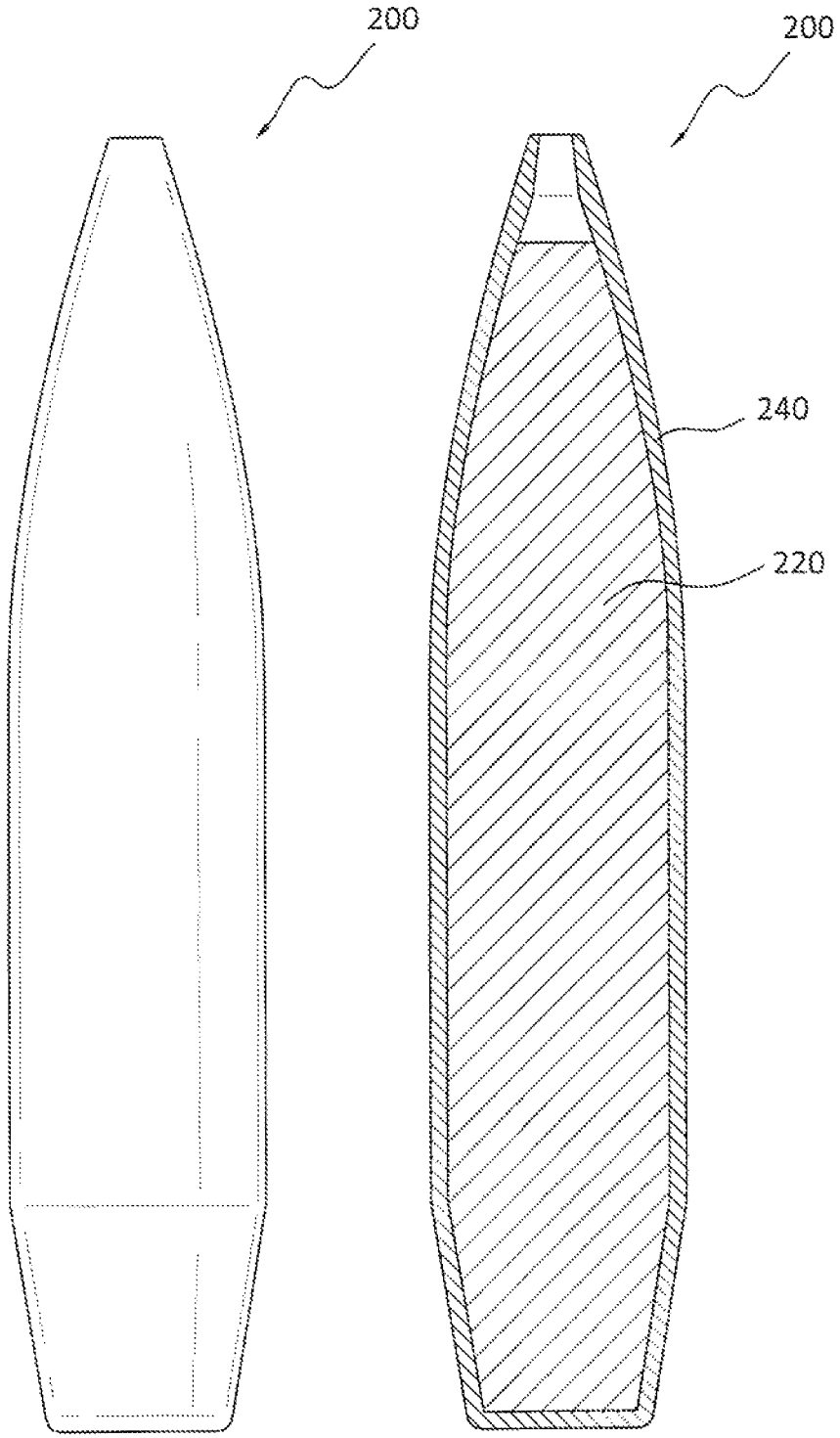
Figure 2A:
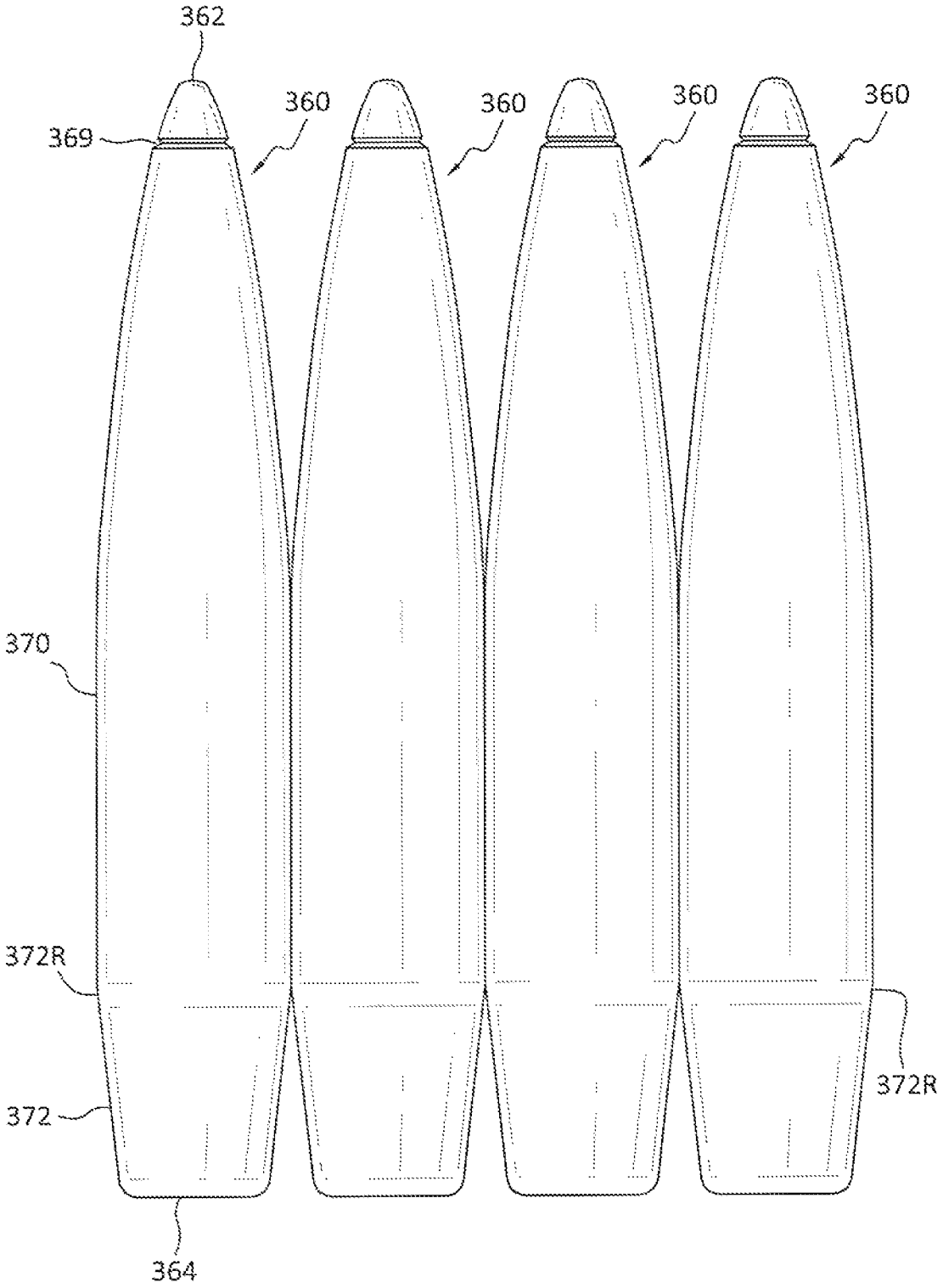
FIGS. 2A and 2B illustrate a side view, in elevation, of a plurality of, the enhanced projectiles that have been engraved on a lathe to provide a surface discontinuity feature configured as a circumferential groove or ring in the distal portion of the nose or ogive portion of the projectiles outer surface, within a selected axial-length distance of the distal tip, in accordance with the present invention.

FIGS. 2A-7B illustrate the novel projectile and ammunition configuration produced with the method of the present invention to provide the benefits of greater accuracy, uniformity and shot-to-shot consistency and repeatability, more uniform observed external ballistics and superior terminal ballistics. In a preferred exemplary embodiment (e.g., as illustrated in FIGS. 2A, 2B, 3A and 3B, an enhanced VLD projectile or rifle bullet 360 is fabricated with or modified to include an external surface discontinuity feature 369 which creates effects in the flowfield (e.g., like the flowfields illustrated in FIGS. 1D and 1E). In accordance with the present invention, when the bullets shown in FIG. 2A are fired, the flowfield effects created by each bullet's substantially identical external surface discontinuity feature 369 are believed to be much more significant than and dominate or become more reliably consistent than the effects from any bullet-to-bullet inconsistency and resultant differences in dynamic behavior observed when each bullet in a string of fire flies through the air.

Figure 2B:
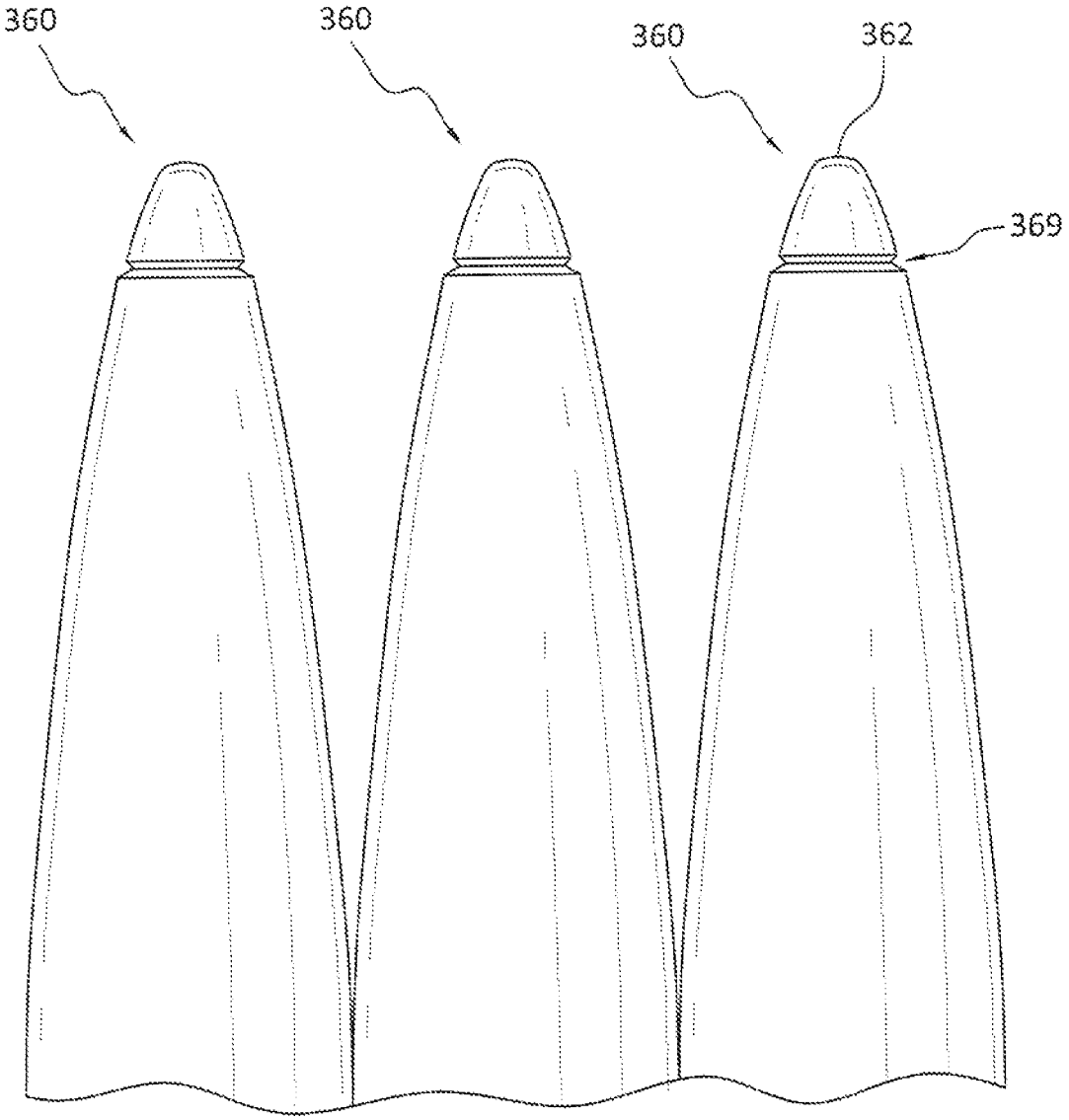

In the preferred embodiment, an engraved or molded-in circumferential groove or ring 369 has a selected profile and depth (e.g., 0.004"-0.015") and is located near the bullet's distal tip (e.g., within 3-25% of the bullet's OAL, and preferably within 100 to 200 thousandths of an inch from the distal tip or meplat of the bullet). The circumferential groove or nose ring discontinuity feature 369 as best seen in FIG. 2B is preferably engraved as a complete circle defined within a transverse plane bisecting the bullet's central axis 360 in the forward ogive section and so is well forward of the central cylindrical bearing surface section of the bullet and well forward of the bullet's center of mass. The surface discontinuity feature or nose ring is defined solely in the distal portion of the nose or ogive portion of the projectile's outer surface, in accordance with the preferred embodiment of the present invention. In the exemplary embodiment of FIGS. 2A-3B, the bullet body has a selected Caliber (e.g., 6 mm or 0.0243 inches) corresponding to its widest outside diameter in central bearing, section 370 and an overall length ("OAL", e.g., 34.3 mm or 1.35 inches) which is at least 5 times that caliber, and the Caliber of Ogive (for the ogive section 368) is preferably greater than 7.

Figure 1H:
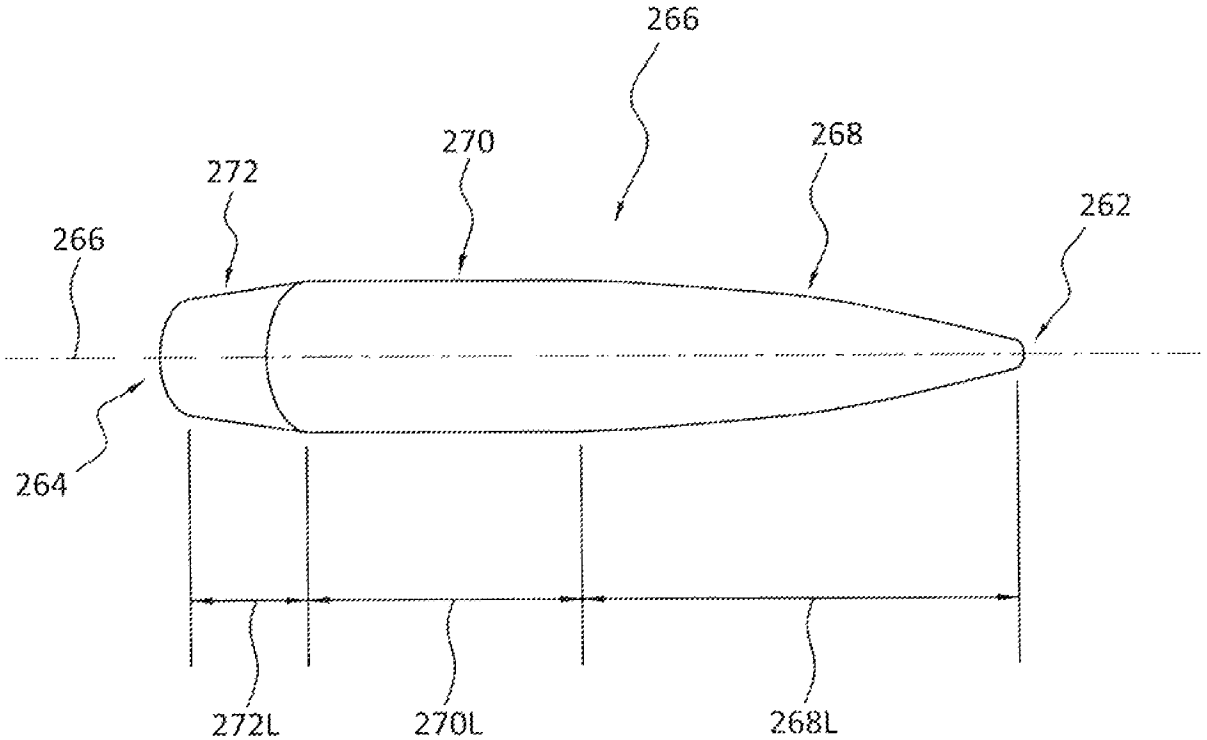
FIG. 1H illustrates a relatively modern but conventional Very Low Drag ("VLD") bullet or projectile, in accordance with the Prior Art.

As noted above and illustrated in FIGS. 3A and 3B, nose ring enhanced bullet 360 of the present invention provides surprisingly uniform shot-to shot external ballistic performance, meaning the demonstrated, measured Ballistic Coefficient ("BC") for a selected plurality of identically made ringed VLD bullets 360 is demonstrated to be much more uniform than the measured BC for a plurality of standard (no-ring) VLD bullets (e.g., 260). Ringed bullet 360 is in many respects similar to the Tubb® DTAC® 6 mm 115 gr bullet or the Sierra® MatchKing® 6 mm 110 gr bullet (e.g., 260, as shown in FIG. 1H), as described above, apart from the external surface discontinuity feature 369. The ringed bullet 360 of the present invention has a distal tip 362 which may terminate distally in a point Of an open tip with or without a meplat. Distal tip 362 may be closed and pointed, and if it is, there is a "transition ridge" very near the distal tip where the jacket material is closed over the formerly open tip aperture. The distal tip 362 is axially aligned along central axis of rotation 366 with an ogive section 368 which grows in diameter toward the full caliber diameter central bearing section 370. The bearing section 370 is cylindrical and has a constant circumference and diameter (e.g., 6 mm) along its length 370L to the proximal boat tail section 372. Ringed VLD bullet 360 may be made from solid copper or bronze alloy or may include a lead alloy core covered in a gilding metal or copper alloy jacket to provide a smooth and continuous outer surface extending from the distal tip 362 to the proximal base surface 364 wherein that smooth continuous surface has only one discontinuity, located within 10% of the bullet's OAL of the distal tip (within ogive 368), and that one discontinuity is defined by the circumferential ring-shaped shallow groove or trough 369. If distal tip 362 is a closed and pointed bullet with a transition ridge nearly at the distal tip where the jacket material is closed over the formerly open tip aperture, ring 369 is defined proximally of that transition ridge (not shown).

Figure 3A:
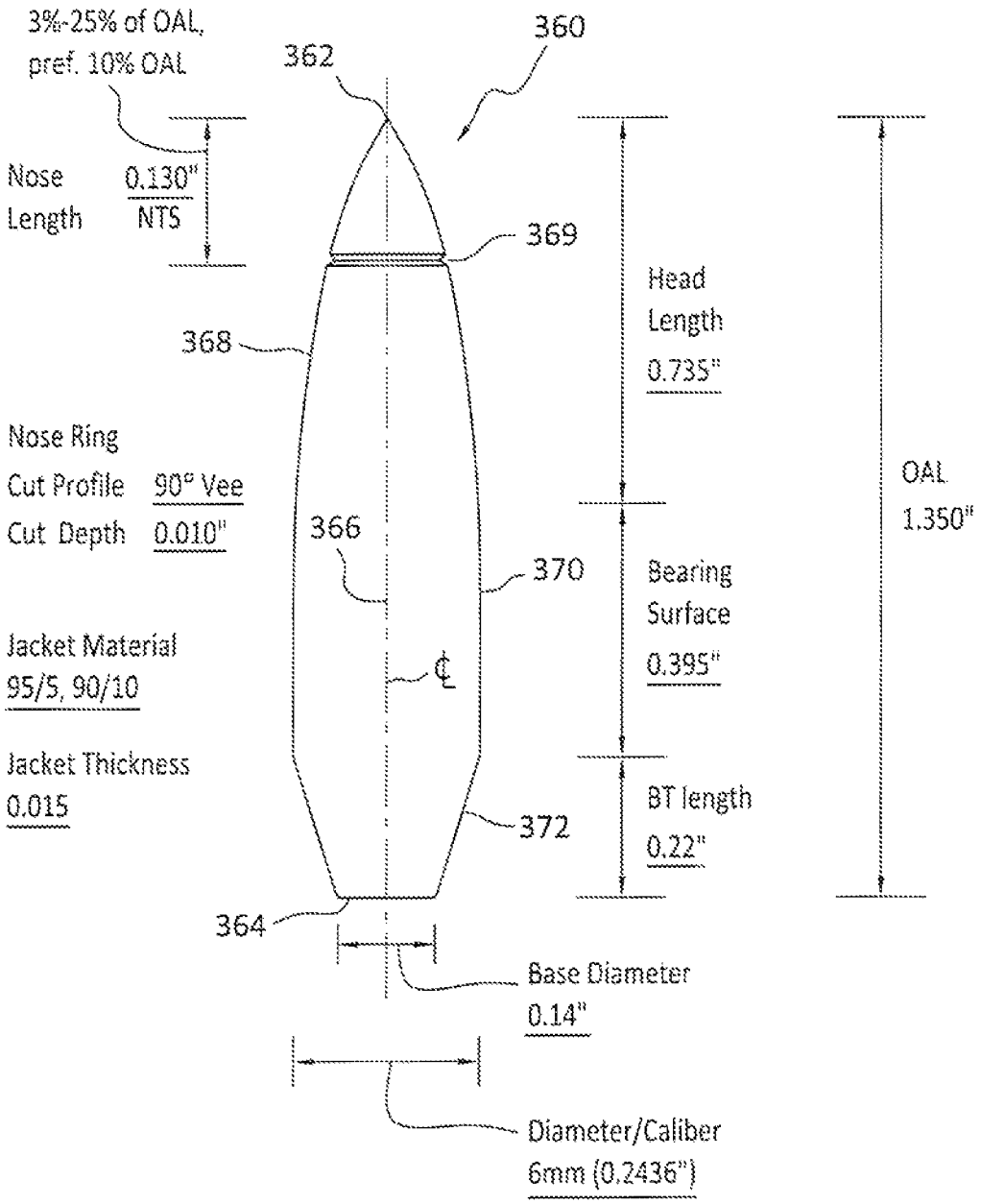
FIG. 3A is an illustrative diagram providing data on dimensions and ballistic performance for the bullets of FIGS. 2A and 2B, in accordance with the present invention.
Figure 3B:
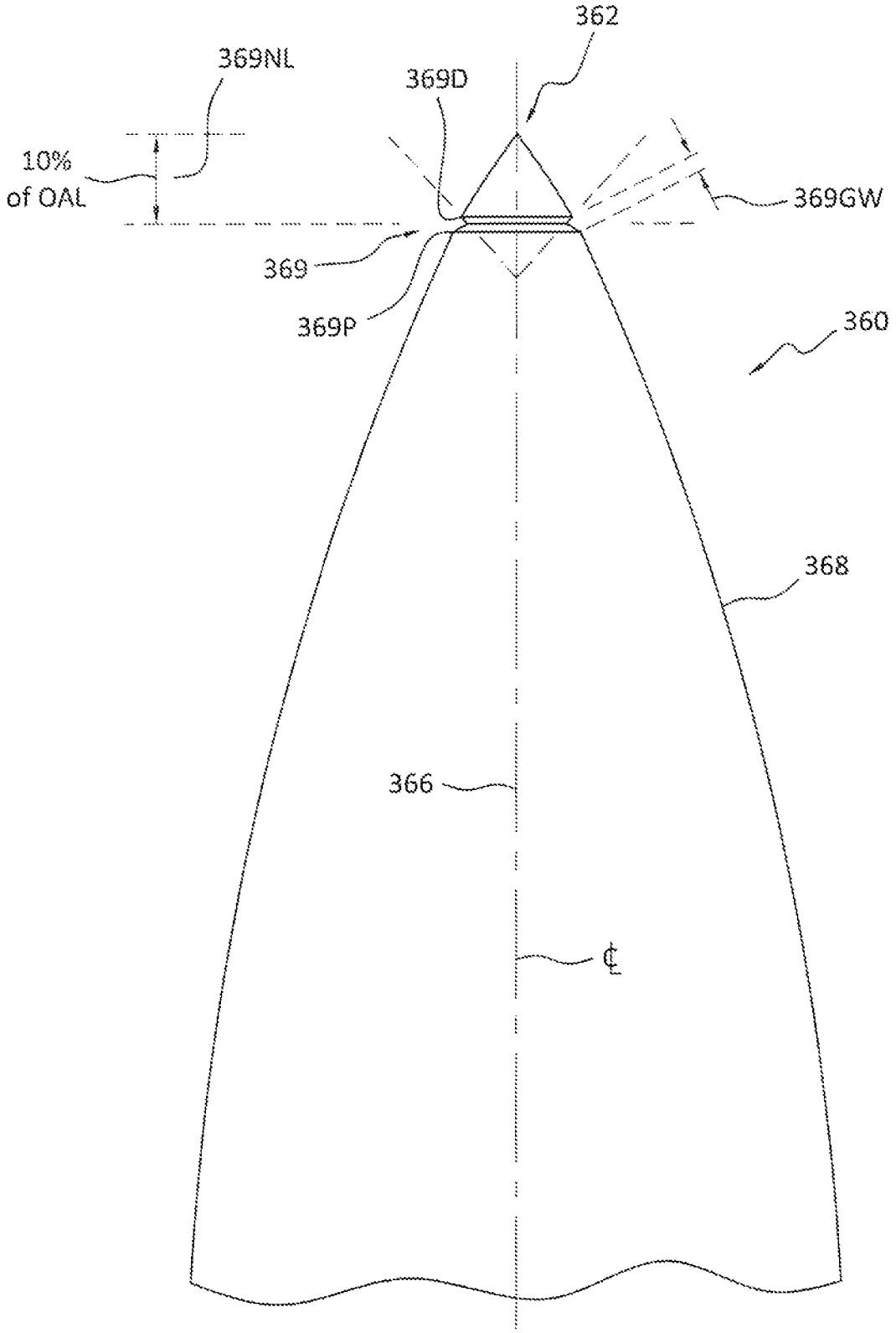
FIG. 3B is a diagram providing an enlarged detail view of the ringed bullet's ogive section, illustrating the shape and contour of the surface discontinuity feature's interior surfaces, in accordance with the present invention.

As illustrated in the enlarged view of FIG. 3B, in an exemplary embodiment, the axial length from tip 362 to the transverse plane of ring groove 369 (or "nose length" 369NL) is 10% of the Overall Length ("OAL") of bullet 360 but applicant's prototype testing indicates that benefits are observed for nose lengths in the range of 3% to 25% OAL. The ogive section 368 of the bullet's body has a first diameter at the distal (front) edge of the nose ring groove 369 and a second larger diameter at the proximal edge of the nose ring groove 369 that is larger than the first diameter, as shown in FIG. 3B, so the flowfield passing from tip to tail over the bullet s external surface profile encounters a gap discontinuity beginning at discontinuity distal edge 369D and then collides with a substantially circumferential edge at the larger second diameter defined by the proximal edge of the nose ring groove 369P which defines the proximal edge of an unsupported gap in the ogive profile having an unsupported gap width 369GW, in the prototype embodiments tested and illustrated here, unsupported gap width 369GW is preferably greater than the discontinuity feature (e.g., groove or cut) depth, and is in the range of 1.3 to 3 times the discontinuity feature depth. In the embodiments illustrated in FIGS. 3A and 3B, unsupported gap width 369GW is preferably 0.020" (twenty thousandths) for the discontinuity feature depth of 0.009 to 0.010" (about ten thousandths).

For enhanced engraved bullet 360, which was tested and generated the ballistics data shown FIG. 4B, the nose length 369NL was 130 thousandths of an inch (0.130"). This nose length was found to provide enhanced BC uniforming, negligible loss in aerodynamic efficiency and was also observed to provide very effective terminal ballistics. Comparable data for un-enhanced (un-engraved) bullets is provided in FIG. 4A. More generally, projectile or bullet 360 has a projectile or bullet body with a first front, distal or ogive section 368, a second central or bearing section 370 and a third proximal or tad section 372, all aligned along a central axis 366 where each of the first, second and third sections are substantially symmetrical about central axis 366. For the 6 mm 115 Grain DTAC® Bullet of FIGS. 2A-3B, the bullet body has an overall length ("OAL") of 1.350 inches defined along central axis 366 between the distal tip 362 and the proximal boat tail end or base surface 364.

The ogive or first distal section 368 of body 360 includes an ogive surface which defines a smooth continuous profile growing in cross sectional diameter to define a transition between the ogive surface and the bearing section surface 370, and the first distal or ogive section terminates distally or forwardly in tip or meplat 362 at the distal end. The first distal section or ogive section 368 carries or provides a surface in which an external ballistic effect uniforming surface discontinuity (e.g., nose ring 369) is cut, engraved or defined and configured as an encircling trough or groove surrounding the circumference of the ogive section near (e.g., within 3-25% of OAL from) the distal end to define an ogive nose surface (forward or distally from the nose ring 369) having a selected nose length (369NL, 0.130 inches, as best seen in FIG. 3B) and an aft ogive surface behind or proximally from the nose ring. In the exemplary embodiment of FIGS. 3A and 3B, nose ring 369 has a selected "cut" depth (e.g., at least 3 thousandths and preferably 6 to 10 thousandths) below the discontinuity edge defined by aft ogive surface and provides a discontinuity gap width 369GW between the ogive nose surface at the forward edge of the ring and the aft ogive surface (e.g., at least 5 thousandths and preferably 10 thousandths) which, in a fired bullet's flight, affects flowfield changes over the ogive section of the bullet body 360.

The external ballistic effect uniforming surface discontinuity or nose ring 369 is preferably engraved, cut in (e.g., by turning the bullet body on a lathe) or molded in situ around the circumference of the ogive section 368 along an imaginary plane that is transverse to central axis 366 to define the nose ring discontinuity and the aft ogive surface extends aft or proximally and expands in cross sectional area to define a transition between the first distal or ogive section and the second bearing section 370, where the central bearing section 370 has a cylindrical sidewall segment and a selected bearing surface having an axial bearing surface length of 0.395 inches (in the exemplary embodiment illustrated in FIGS. 2A and 3A). Central bearing section 370 extends rearwardly or proximally to a proximal portion defining a transition between the second bearing section and the third or tail section 372, where the tail section comprises an aft or proximal boat-tail (or base section) terminating proximally at the proximal end in base surface 364. The boat tail section 372 may optionally include a rebated outside diameter reducing contour or ridge 372R between central bearing section sidewall 370 and the proximal or aft portion of boat tail section 372.

The first or ogive section's external ballistic effect uniforming surface discontinuity (e.g., nose ring 369) preferably is engraved or cut-in using a tool to provide a Vee-shaped groove which is defined in an imaginary transverse plane and so provides and abrupt surface discontinuity shown circumferentially around the bullet's ogive sidewall, and, as seen in FIG. 3B, wherein the ogive nose surface in front of the nose ring groove has a first smaller diameter at the distal or forward edge of the nose ring groove and a second larger diameter at the proximal or aft edge of the nose ring groove. The aft edge of the nose ring groove defines an annular surface feature that is larger than the forward edge's first diameter to provide an abrupt discontinuity for the flowfield passing over the projectile's ogive surface.

Prototype Development and Testing to Confirm External Ballistic Characteristics

Detailed notes on the prototype projectile test work for the plain (conventional) and enhanced or "ringed" projectiles included shooting at selected targets at different ranges, noting atmospheric data for each shooting session, muzzle velocities, and the accuracy potential at various distances to determine supersonic behavior, transition behavior and subsonic behavior. The enhanced prototype bullets were shot at 995.7 yards and beyond. Applicant's extensive experience has shown that a high B.C. solid bullet may in actual live fire testing appear to provide stable flight at shorter ranges (e.g., when velocities are well above the supersonic to subsonic transition velocities) but may also demonstrate unstable flight at transition velocities and may then be so unstable as to miss a target at subsonic velocities. The tested projectiles described below were observed to maintain stability at known ranges prior to any long-range stability and accuracy testing to the outermost reach of each projectile's supersonic flight.

Ballistic Coefficient ("BC") verification testing for the unmodified (conventional) and newly modified ringed bullets (e.g., 360 or 460) of the present invention was undertaken to determine (and then confirm) the BC for selected samples comprising pluralities of the projectiles at selected distances as they were passing over a down-range acoustic chronograph sensor array. Testing included shooting the various prototype bullets to determine stability and velocity (using an Ohler™ model 35P chronograph system with the proof channel accessories) and observed ballistic coefficient ("BC") metrics were gathered and tabulated (e.g., as shown in FIGS. 4A, 4B, 7A and 7B). The acoustic chronograph system used in Applicant's tests employed sensors located hundreds of yards apart downrange from the firing point. For the particular tests described in this application, the shortest total distance shot was 995.7 yards (for the 6 mm 115 gr. DTAC™ bullets) and the longest was over 2000 yards (e.g., for .375 turned solid bullet 460 of FIGS. 5A, 5B, 5C, 6, 7A and 7B).

Figure 5A:
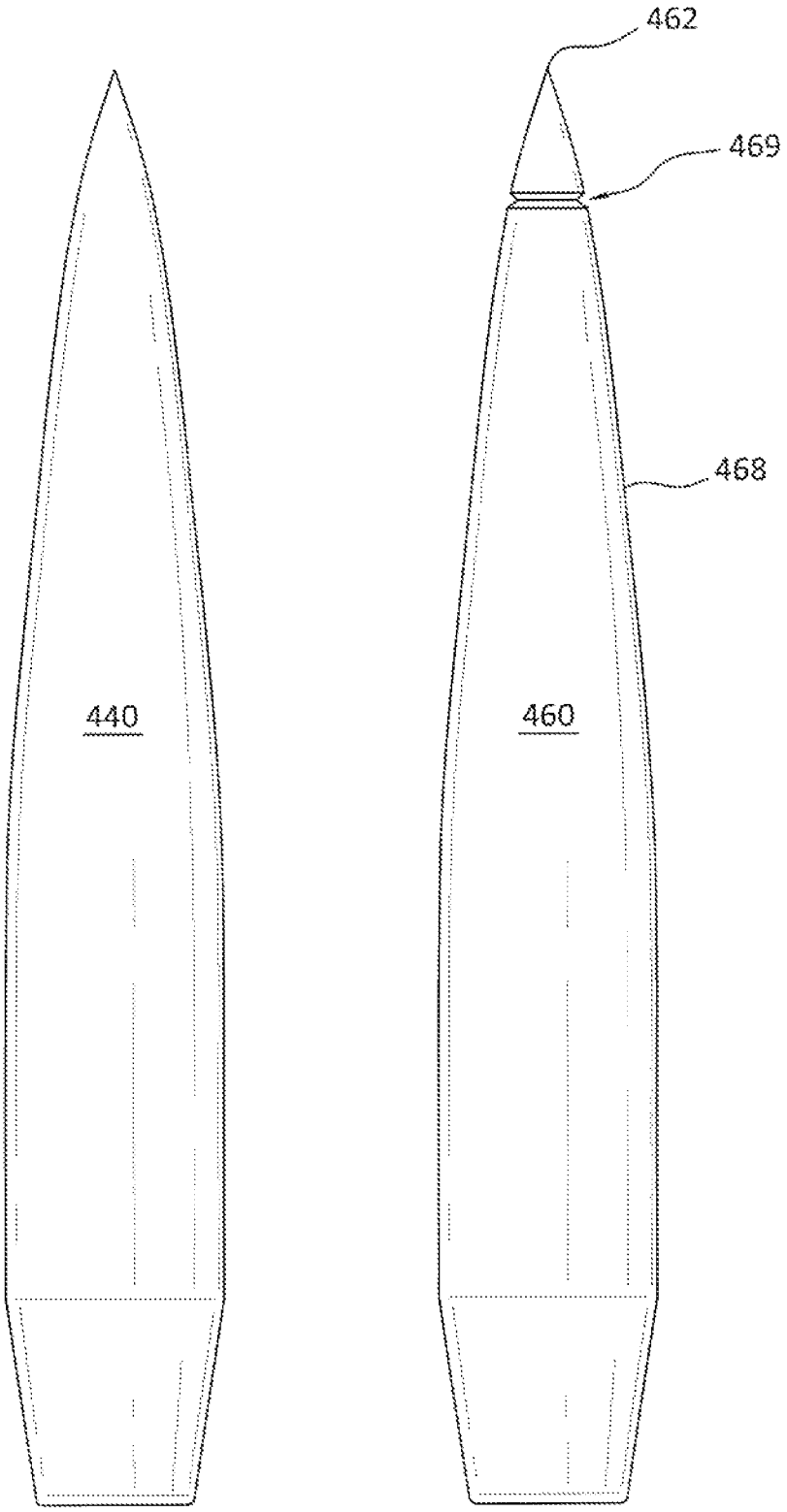
FIG. 5A is a side view, in elevation, illustrating (on the left) a conventional 375 Lapua™ turned solid VLD projectile and (on the right) an enhanced or modified 375 Lapua turned solid VLD projectile which includes the external surface discontinuity feature 369 or circumferential groove or ring in the distal portion of the nose or ogive portion of the projectile's outer surface, within a selected axial-length distance of the distal tip, in accordance with the present invention.

Turning now to FIGS. 5A-7B an enhanced (ringed) 375 Lapua™ turned solid bullet 460 modified to include the discontinuity feature of the present invention provides surprisingly improved and more uniform shot-to-shot external ballistic performance, meaning the demonstrated, measured Ballistic Coefficient ("BC") for a selected plurality of ringed bullets 460 was confirmed to be much more uniform than the measured BC for a plurality of standard (no-ring) conventional 375 Lapua™ turned solid VLD projectiles (e.g., 440). The enhanced (Ringed) bullet 460 is in many respects similar to the conventional 375 Lapua turned solid VLD projectile (e.g., 440, as shown in FIG. 5A), which does not have good transonic stability, as described above. Theo ringed bullet of the present invention has a distal tip 462 which may terminate distally in a point (as shown) or an open tip with or without a meplat (not shown). The distal tip 462 is axially aligned along central axis of rotation 466 with an ogive section 468 having a continuous surface profile which grows in diameter proximally toward the full caliber diameter central bearing section 470. The bearing section 470 is substantially cylindrical and has a constant circumference and diameter (e.g., 375 caliber or 0.375") along its length 470L to the proximal boat tall section 472 (but may include "drive bands" in bearing section 470, not shown). Ringed bullet 460 may be made from solid copper or bronze alloy or may include a lead alloy core covered in a gilding metal or copper alloy jacket (not shown) to provide a smooth and continuous outer surface and profile extending from the distal tip 462 to the proximal base surface 464 where that smooth continuous surface or profile has only one discontinuity, located within 3-25% (preferably 10%) of the bullet's OAL of the distal tip (within ogive 468), and that one discontinuity is defined by the circumferential ring-shaped shallow groove or trough 469. In the exemplary embodiment of FIGS. 5A-7B, the bullet body has a selected Caliber (e.g., 0.375 inches) corresponding to its widest outside diameter in central bearing section 470 and an overall length ("OAL", e.g., 2.2 inches) which is at least 5 times that caliber, and the Caliber of Ogive (for the ogive section 468) is preferably greater than 7.

Figure 5B:
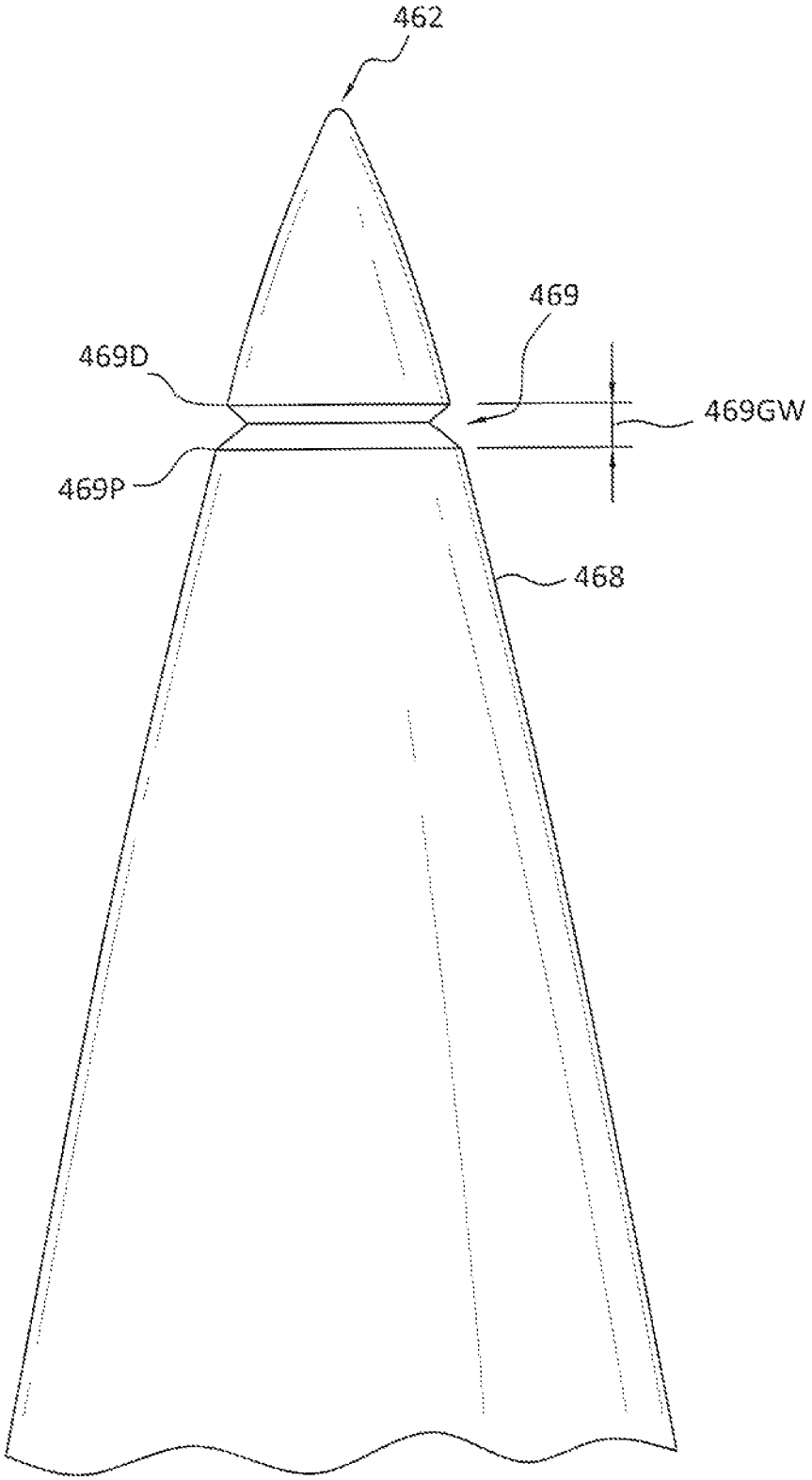
FIG. 5B is an enlarged detail view of the distal tip and nose section for the enhanced projectile of FIG. 5A, illustrating the shape and contour of the groove's interior surfaces, in accordance with the present invention.
Figure 5C:
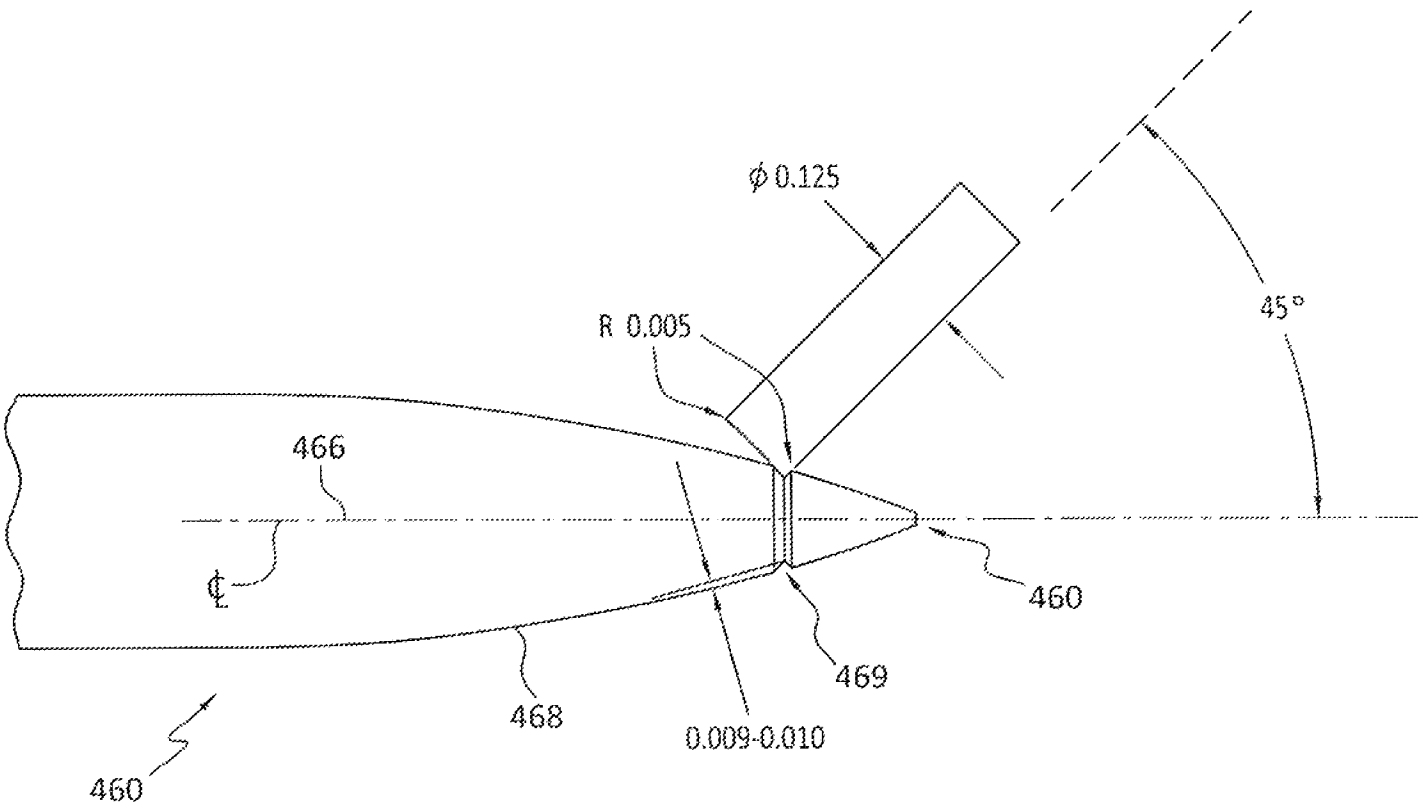
FIG. 5C is a diagram providing an enlarged detail view of the machining method and orientation for the tool and the resulting surface discontinuity machined into the bullet ogive section of FIGS. 5A and 5B, in accordance with the present invention.
Figure 6:
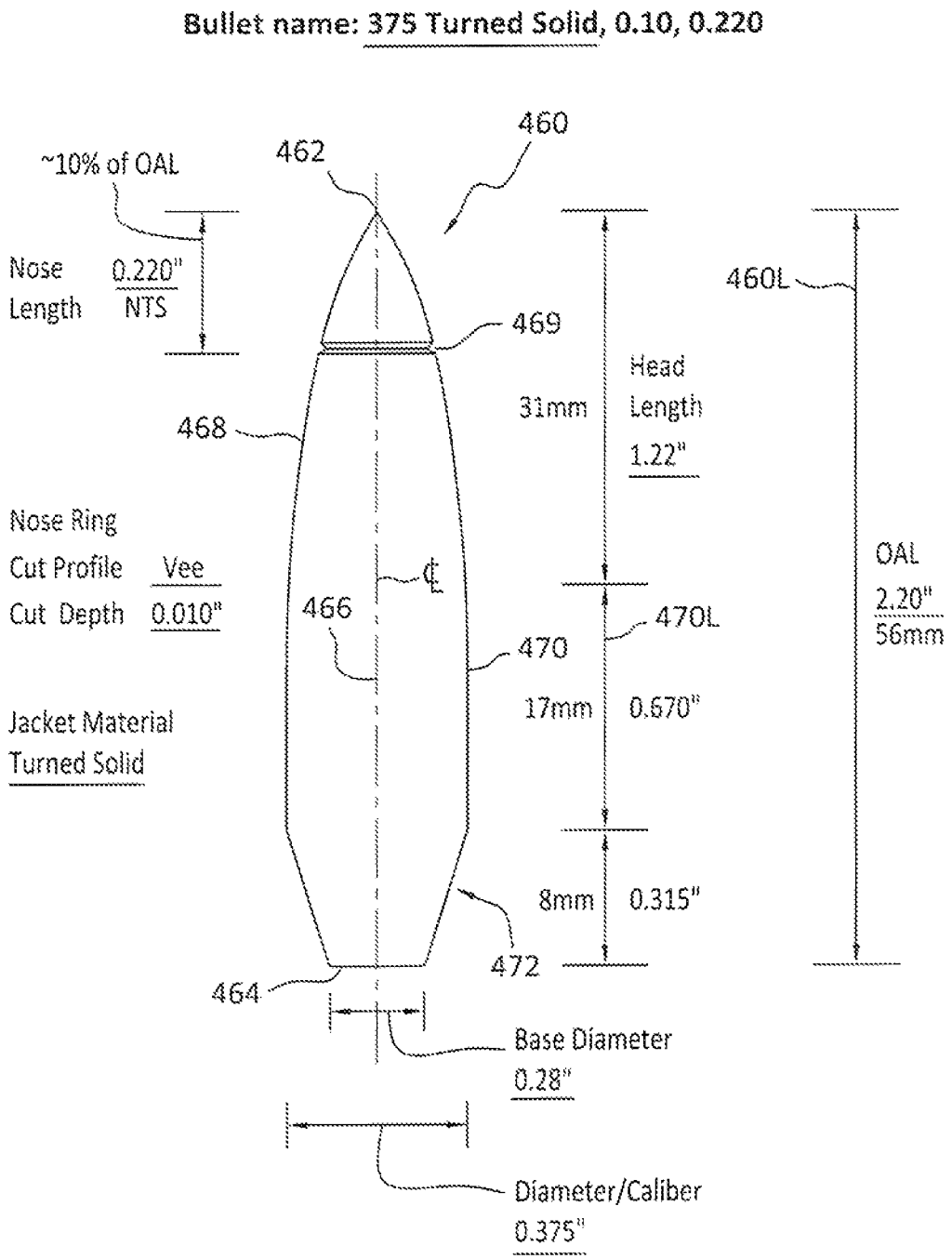
FIG. 6 is an illustrative diagram providing data on dimensions and ballistic performance for the bullet of FIGS. 5A and 5B, in accordance with the present invention.

As illustrated in the enlarged view of FIG. 5B and the diagram of FIG. 5C, the ogive section of bullet 460 is preferably engraved, machined or cut to include a nose section distally from the ring or external ballistic effect uniforming surface discontinuity 469. The geometry of ring groove 469 is preferably engraved in a method or process which includes installing a ⅛" end mill tool (90 degree Vee, 6 flute) on a compound angle tool holder set at 45 degrees from the central axis of rotation for a lathe (coaxial with the bullet's central axis 466, as shown in FIG. 5C) and advancing the tool in a plane transverse to the axis of rotation, cutting ring groove 469 to the selected groove depth of 0.009" to 0.010". A ring groove depth of greater than 0.004 is believed to be required in order to reliably create the effects which aid in BC uniforming, but accuracy and BC uniforming are enhanced further with groove depths of 6 to 10 thousandths of an inch. The ogive section 468 of the bullet's body has a first diameter at the distal (front) edge of the nose ring groove 469D and a second larger diameter at the proximal edge of the nose ring groove 469P that is larger than the first diameter, as shown in FIG. 5B, so the flowfield passing from tip 462 to tail 464 over the bullets external surface profile encounters the gap discontinuity beginning at discontinuity distal edge 469D and then collides with a substantially circumferential edge at the larger second diameter defined by the proximal edge of the nose ring groove 469P which defines the proximal edge of an unsupported gap in the ogive profile having a gap width 469GW. In the prototype embodiments tested and illustrated here, unsupported gap width 469GW is preferably greater than the discontinuity feature (e.g., groove) depth, and is in the range of 1.3 to 3 times the discontinuity feature depth. In the embodiments illustrated in FIGS. 5A, 5B and 6, unsupported gap width 469GW is preferably 0.020" (twenty thousandths) for the discontinuity feature depth of 0.009 to 0.010" (about ten thousandths).

The nature of the discontinuity which creates the BC uniforming effect is more clearly illustrated in the enlarged detail view of FIG. 5B and FIG. 5C which, shows the groove profile and the resulting surface discontinuity for nose ring 469, where the nose ring groove comprises a roughly vee-shaped trough or groove of selected groove depth (0.009" to 0.10") which necessarily affects the flowfield from distal tip 462 proximally, along the ogive surface of the bullet. In applicant's original development work, the ringed bullets of the present invention (e.g., 360, 460) were modified to enhanced terminal ballistics, and a groove depth of 10 thousandths was found to provide significantly improved terminal ballistics and, surprisingly, enhanced accuracy and BC uniforming as compared to conventional VLD projectiles, including the conventional 375 Lapua turned solid VLD projectile 440.

Live fire experiments with prototypes led to the development of the external ballistic effect uniforming surface discontinuity or ring (e.g., 369, 469) described and illustrated in FIGS. 2A through 7, in which the ogive surface, near the distal tip includes a nearly conical distal ogive nose section surface which is interrupted with the groove beginning at a distal edge (e.g., 469D) having a first smaller diameter (as best seen in the enlarged image of FIG. 5B). It is believed that the flowfield passing distally over the bullet's external surface, from nose to tail, is affected by the surface discontinuity which includes a proximal edge (469P, which has a larger diameter than the distal edge 469D), and that effect on the flowfield (from the discontinuity or ring) becomes a dominant contributor to the dynamic mechanisms which control the external ballistic performance of the projectiles that include the external ballistic effect uniforming surface discontinuity of the present invention.

Turning now to FIGS. 7A and 7B, ballistics testing performance data was recorded for experiments with the conventional 375 Lapua turned solid VLD projectile 440, without circumferential nose ring 469 (a summary of the ballistics data is also annotated in FIG. 6) FIG. 7B describes and illustrates ballistics testing performance data recorded for experiments with the ringed 375 Lapua turned solid VLD projectile 460 of FIGS. 5A-5C showing the shot-to-shot external ballistics (BC) uniforming effect caused by inclusion of the circumferential groove or ring 469 in the distal portion of the nose or ogive portion of the projectile's outer surface, in accordance with the present invention. Based on these observations (for the illustrated prototypes and others) the ring-nosed projectiles of the present invention (e.g., 360, 460) were found to provide significantly more uniform BC performance. The enhanced projectiles of the present invention (e.g., 380) may be manufactured as lead core within copper jacket projectiles (using a drawn ticket with a molded core or a forged or molded core with a vapor deposited jacket) or as monolithic solid projectiles (e.g., 460), with the ring groove (e.g., 369 or 469) in situ, or the ring groove may be cut, machined or etched into the ogive section of a VLD bullet body, in accordance with the method of the present invention.

Returning to FIG. 5C, a diagram illustrating the orientation of a selected bullet body in a machine tool with a cutting die is illustrated, and in one exemplary method for making the enhanced projectile of the present invention, the method steps include: (a) providing a VLD projectile or bullet body (e.g., 360, 460) comprising a first distal or ogive section (e.g., 368, 468), a second central or bearing section (e.g., 370, 470), and a third proximal or tail section (e.g., 372, 472), all aligned along a central axis (e.g., 366, 466), where each of said first, second and third sections are substantially symmetrical about that central axis, and the bullet body's central axis is the central axis for the cutting or engraving operation as shown, which is near the distal end in the first distal section's ogive surface. As noted above, the bullet body has a selected Caliber corresponding to its widest outside diameter in central bearing section (370 or 470) and said an overall length ("OAL") is at least 5 times the caliber diameter, and wherein said ogive section has an ogive surface profile radius or Caliber of Ogive that is greater than 7. Once the bullet body is secured in the machine tool, the next step is engraving or cutting the nose ring or groove which provides a surface discontinuity defining feature in the bullet body ogive section to create an unsupported surface gap in the ogive section's continuous surface profile to define the external ballistic effect uniforming surface discontinuity (e.g., 369, 469) which is cut, etched or engraved to the selected profile and depth (e.g., 0.004"-0.015"). The cutting tool or die preferably has a rectangular sectioned body with a cutting edge defining a radiussed corner with a small (e.g., 0.005 inch) radius, and the tool is preferably angled at 45 degrees, as shown in FIG. 5C). Before the discontinuity feature (e.g., 469) is engraved, the tool is positioned to leave a distal ogive section or nose length of about 0.2 inches, meaning the cut is near (e.g., within 0.2") the bullet's distal tip or meplat.

Having described preferred embodiments of a new method fort Peking an improved projectile, ammunition configuration which provides the benefits of greater accuracy, uniformity and shot-to-shot consistency and repeatability, more uniform observed external ballistics and superior terminal ballistics, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A method for making an enhanced projectile, comprising:

providing a projectile body (e.g., 360, 460) comprising a distal first section (e.g., 368, 468), a bearing second section (e.g., 370, 470), and a proximal third section (e.g., 372, 472), all aligned along a central axis (e.g., 366, 466), wherein each of the first, second and third sections are substantially symmetrical about the central axis, wherein the projectile body has an overall length defined along the central axis between a distal end and a proximal end of the projectile body, wherein the distal first section of the projectile body comprises an ogive surface with a continuous surface profile defining a transition between the ogive surface and the bearing second section, wherein the distal first section terminates distally in a tip or a meplat (e.g., 362, 462) at the distal end, wherein the projectile body has a selected Caliber corresponding to a widest outside diameter of the bearing second section (e.g., 370 or 470), wherein the overall length of the projectile body is at least 5 times the widest outside diameter, and wherein the distal first section has an ogive surface profile radius or Caliber of Ogive that is greater than 7; and modifying the ogive surface to provide a surface discontinuity defining feature into the ogive surface of the distal first section of the projectile body to create an unsupported surface gap in the continuous surface profile to define an external ballistic effect uniforming surface discontinuity (e.g., 369, 469) therein which affects the flow of air over a front half of the distal first section, wherein the surface discontinuity defining feature is cut to a selected profile and depth and is located in proximity to the tip or meplat.

2. The method of claim 1, wherein said modifying comprises engraving the surface discontinuity defining feature into the distal first section of the projectile body.

3. The method of claim 1, wherein said modifying comprises cutting the surface discontinuity defining feature into the distal first section of the projectile body.

4. The method of claim 1, wherein said modifying comprises etching the surface discontinuity defining feature into the distal first section of the projectile body.

5. The method of claim 1, wherein the surface discontinuity defining feature has a depth in a range of 0.004 inch to 0.015 inch and is positioned within 0.2 inch of the tip or meplat.

6. The method of claim 1, wherein an axial length along the central axis from the distal end to a transverse plane intersecting the surface discontinuity defining feature is within 3-25% of the overall length of the projectile body.

* * * * *